US008656688B2

(12) United States Patent
Schonfelder et al.

(10) Patent No.: US 8,656,688 B2
(45) Date of Patent: Feb. 25, 2014

(54) CAPPER

(75) Inventors: Markus Schonfelder, Regensburg (DE); Peter Schwarzfischer, Laberweinting (DE); Lutz Kampmann, Neutraubling (DE)

(73) Assignee: Krones AG, Neutraubling (DE)

( * ) Notice: Subject to any disclaimer, the term of this patent is extended or adjusted under 35 U.S.C. 154(b) by 580 days.

(21) Appl. No.: 12/959,407

(22) Filed: Dec. 3, 2010

(65) Prior Publication Data

US 2011/0131923 A1 Jun. 9, 2011

(30) Foreign Application Priority Data

Dec. 4, 2009 (DE) ..... 10 2009 047 543

(51) Int. Cl.
*B67B 3/20* (2006.01)
*B65B 7/28* (2006.01)

(52) U.S. Cl.
USPC ..... 53/329; 53/317; 53/331.5

(58) Field of Classification Search
USPC ..... 53/368, 317, 329, 331.5
See application file for complete search history.

(56) References Cited

U.S. PATENT DOCUMENTS

| | | | | |
|---|---|---|---|---|
| 1,598,392 A | | 8/1926 | Kisser | |
| 1,835,336 A | * | 12/1931 | Risser | 53/294 |
| 3,559,702 A | | 2/1971 | Riesenberg | |
| 3,707,822 A | | 1/1973 | van der Meer | |
| 4,535,583 A | * | 8/1985 | Tanaka et al. | 53/75 |
| 4,696,144 A | * | 9/1987 | Bankuty et al. | 53/331.5 |
| 5,111,635 A | * | 5/1992 | Neber | 53/334 |
| 5,197,258 A | * | 3/1993 | Johanek | 53/317 |
| 5,417,031 A | * | 5/1995 | Bankuty et al. | 53/331.5 |
| 5,419,094 A | * | 5/1995 | Vander Bush et al. | 53/75 |
| 6,519,913 B2 | * | 2/2003 | Higashizaki et al. | 53/75 |
| 7,251,921 B2 | * | 8/2007 | Galimberti et al. | 53/317 |
| 7,472,527 B2 | * | 1/2009 | Brunee | 53/490 |
| 7,533,590 B2 | * | 5/2009 | Cirio | 74/89.23 |
| 7,661,245 B2 | * | 2/2010 | Brown | 53/317 |
| 7,836,664 B2 | * | 11/2010 | Zanini et al. | 53/317 |

(Continued)

FOREIGN PATENT DOCUMENTS

| | | |
|---|---|---|
| CN | 2121443 U | 11/1992 |
| CN | 2527546 Y | 12/2002 |

(Continued)

OTHER PUBLICATIONS

German Search Report for DE102009047543.5, dated Aug. 5, 2010.

(Continued)

*Primary Examiner* — Hemant M Desai
*Assistant Examiner* — Gloria R Weeks
(74) *Attorney, Agent, or Firm* — Marshall, Gerstein & Borun LLP

(57) ABSTRACT

A capper used for a great variety of containers and comprising a container carrier, which is adapted to be driven by a capper drive motor for transporting the containers on a lower part, and an upper part, which carries at least one closing element and which is also adapted to be driven by the capper drive motor, the upper part being vertically adjustable relative to the lower part at least for adaptation to different container heights, and where the upper part is vertically adjusted by the capper drive motor, and that a clutch system is provided, which is adapted to be selectively switched between a drive function and an upper-part height adjustment function.

26 Claims, 4 Drawing Sheets

(56) References Cited

U.S. PATENT DOCUMENTS

| | | | | |
|---|---|---|---|---|
| 8,353,145 | B2 * | 1/2013 | Zanini et al. | 53/302 |
| 8,359,818 | B2 * | 1/2013 | Liu et al. | 53/510 |
| 8,418,429 | B2 * | 4/2013 | Li et al. | 53/317 |
| 2006/0272284 | A1 * | 12/2006 | Galimberti et al. | 53/75 |
| 2010/0089004 | A1 | 4/2010 | Data | |

FOREIGN PATENT DOCUMENTS

| | | | |
|---|---|---|---|
| CN | 201284213 | Y | 8/2009 |
| DE | 2736206 | A1 | 2/1979 |
| DE | 102008037101 | A1 | 2/2010 |
| EP | 0571980 | A2 | 12/1993 |
| GB | 1427839 | A | 3/1976 |
| JP | 6263189 | A | 9/1994 |
| WO | WO-2006087088 | A2 | 8/2006 |
| WO | WO-2009068166 | A1 | 6/2009 |

OTHER PUBLICATIONS

Chinese Office Action for 201010579443.2, Dated Jul. 17, 2012.

Search Report from European Patent Office for application No. EP10189245, dated Apr. 22, 2013.

* cited by examiner

CAPPER

CROSS-REFERENCE TO RELATED APPLICATION

The present application claims the benefit of priority of German Application No. 102009047543.5, filed Dec. 4, 2009. The entire text of the priority application is incorporated herein by reference in its entirety.

FIELD OF THE DISCLOSURE

The present disclosure relates to a capper of the type used with containers in beverage bottling operations.

BACKGROUND

Cappers of the type shown in WO 2006/087088 A are, in practice, configured such that, for vertically adjusting the upper part, a separate drive motor is mounted, e.g. a gear motor which adjusts the upper part via a spindle and which, making use of a Balluff sensor, determines the desired height of the upper part. To this end, the gear motor is arranged in the area of the upper part or below a table plate from which the adjusting spindle extends upwards, e.g. through a main bearing shaft. In the case of these known height adjustment means, the additional drive motor entails a substantial expenditure. In addition, the height adjustment range is disadvantageously limited, and an indirect height adjustment via a sensor is necessary. The height adjustment cannot be automated and requires a substantial amount of installation space. Furthermore, the known height adjustment is difficult to realize when operating media, such as liquids, electric current and pressurized air, are used in the upper part. Electric current supplied through control lines is required for driving servo motors, whereas pneumatic control units are required for gripping heads and the like. Modern cappers making use of a servo motor as a capper drive motor do not offer lower installation space, an that it is not possible to provide a bottom-type drive motor used for height adjustment and provided with the passage through a main bearing shaft, which is required for the spindle.

SUMMARY OF THE DISCLOSURE

It is an aspect of the present disclosure to provide a capper of the type specified at the beginning, which, especially when servo motor technology is used, has a simplified structural design and allows even an automated height adjustment of the upper part.

In view of the fact that the capper drive motor fulfills, in addition to its drive function, also the height adjustment function for the upper part, it is no longer necessary to provide an additional drive motor for adjusting the height, and the capper can be provided with a structural design that is simpler and that allows even an automated adjustment of height. The clutch system that can be switched by remote control allows, when occupying the drive-function switching position, that all the components of the capper which are to be driven substantially synchronously are centrally driven. When the clutch system has, however, been switched to the switching position provided for the height adjustment function, it allows a height adjustment of the upper part by means of the capper drive motor, without simultaneously driving components in the upper part which are to be rotationally driven. Advantages of this system are, inter alia, a comparatively large height adjustment range and a shielded accommodation of all the driving components, also of those used for adjusting the height, so that neither cleaning media nor other external influences will cause damage or contaminations in the interior of the capper. This kind of encapsulation even allows a thorough cleaning of the capper at locations where such cleaning has hitherto not been admissible. The height adjustment can be fully automated, e.g. depending on sort parameters. In addition, the capper drive motor allows to achieve a high adjustment accuracy, e.g., depending on the respective structural design, approx. ±0.3 mm. In view of the fact that by means of the capper drive motor, and especially in the case of automated height adjustment, the height adjustment of the upper part can be carried out very precisely, it will perhaps be possible to dispense with the use of a sensor that has hitherto been necessary for adjusting the height position.

It is true that it is known from another container treatment machine, viz. from a filler according to DE 27 36 206 A, which does not belong to the same class of device, to use a common drive for operating in the vertical direction either lifting spindles of the lid of a vessel or a support column, but, in the case of this container treatment machine, connecting screws have to be released by hand, transferred to the drive connection in question, and retightened.

According to an expedient embodiment of the present capper, the capper drive motor is a servo-drive motor arranged in table carrying the lower part, i.e. it is arranged at a central location of the capper and in such a way that it is shielded against external influences or cleaning media. The servo-drive motor allows a precise and position-accurate control of rotary movements and generates, if necessary, e.g. a high torque or very small rotary increments.

According to a further and particularly important concept of the present disclosure, the capper is so conceived that, when the height adjustment function is activated, the upper part is vertically adjustable relative to the lower part until it is rotationally decoupled from the capper drive motor. This additional function of totally decoupling the upper part can be desirable in particular in cases where a plant comprises a plurality of cappers which, as regards their upper part, are only active in cycles, whereas, when the upper part is not active, only the respective lower part must be driven for the purpose of conveying the containers. This further function can be realized without any additional expenditure that would be worth mentioning and can be provided in combination with a very large height adjustment range of the upper part.

According to a further embodiment, the upper part and the lower part have provided between them a hollow shaft, which is provided with a female thread and which is vertically adjustable relative to the lower part, and, in the hollow shaft, a threaded spindle, which is rotationally connected to the capper drive motor and which is provided with a male thread that is in mesh with said female thread, said threaded spindle being, when the upper-part height adjustment function is activated, adapted to be rotated relative to the hollow shaft by means of the capper drive motor and adjusting said hollow shaft with the upper part in the vertical direction. The hollow shaft is guided in the interior of an outer shaft, which is connected to the lower part and the container carrier, such that it is at least axially displaceable. The outer shaft is able to drive, when the drive function has been activated, the upper part components which are to be rotationally driven.

According to an expedient embodiment, the switchable clutch system, with the aid of which the capper drive motor is used for rotationally driving various components of the capper and, selectively, for adjusting the height of the upper part, comprises a hollow spline shaft, which is provided on a drive shaft with a taper key structure connected to the capper drive motor and the threaded spindle and which is adapted to be linearly adjusted between positions corresponding to the drive function and the height adjustment function, said hollow spline shaft being arranged in the interior of an outer tube which carries the container carrier and which drives the outer shaft. It will be expedient when the hollow spline shaft and the outer tube have provided between them a gear coupling, which is adapted to be engaged and disengaged through a linear displacement of the hollow spline shaft and which is adapted to be used for selectively establishing a rotary connection between the hollow spline shaft and the outer tube or decoupling the hollow spline shaft from said outer tube. Due to the linear displacement of the hollow spline shaft, the rotary connection to at least some of the components in the upper part is interrupted, whereas the threaded spindle is still rotationally connected to the capper drive motor, so that the rotary movement of the threaded spindle will displace the hollow shaft, which displaces the upper part in the vertical direction. If the gear coupling is, however, engaged, the outer shaft connected to the container carrier and the threaded spindle as well as the vertically adjustable hollow shaft are rotationally driven in common without displacing the threaded spindle within the hollow shaft (drive function).

According to an expedient embodiment, the gear coupling is spring-biased into the position of engagement, preferably by means of springs provided between the hollow shaft and a rotary bearing of the outer tube. The springs can be configured such that, when the capper is in operation, the gear coupling will reliably be maintained in its engaged condition when the drive function has been activated.

According to an expedient embodiment, the gear coupling is disengaged pneumatically. This can be done directly or indirectly by a remotely controllable actuator, such as a pneumatic cylinder producing a linear adjustment stroke for the hollow spline shaft. The term indirectly can here be interpreted as an embodiment in the case of which an operating shaft, which is displaceably arranged in the drive shaft and adapted to be displaced by the pneumatic cylinder, is used for transmitting the adjustment stroke to the interior hollow spline shaft from outside. Alternatively, any stroke drives, such as e.g. linear servo motors, electromagnets, etc. can be used.

Predominantly in order to allow easy mounting of the compact clutch system, the operating shaft or drive shaft and the hollow spline shaft can have provided between them a selectively releasable detent coupling. This detent coupling is preferably provided with locking entrainers which are arranged on the operating shaft and which are adapted to be inserted in a star-shaped mode into engagement recesses of the hollow spline shaft through windows of the drive shaft. The locking entrainers are retractable by means of a relative partial rotational movement of the operating shaft relative to the then stationary drive shaft, preferably under spring force, so as to separate the operating shaft and the drive shaft from one another, and by means of a corresponding return or advance rotational movement they are again extended from the windows of the drive shaft and into the engagement recesses.

According to a particularly expedient embodiment, a selectively operable, preferably mechanical, pneumatic or magnetic locking brake is provided for the rotationally driveable components of the upper part or the upper part as such. Said locking brake is preferably provided between a clamping disk of the upper part and a non-rotatably supported cover disk of the upper part. For executing a height adjustment, the locking brake is kept engaged until the height adjustment is finished. The locking brake is, however, also engaged and kept engaged, when the upper part is fully rotationally decoupled from the capper drive motor. The engaged locking brake absorbs the reaction torque that is generated in the vertically adjustable hollow shaft e.g. when the threaded spindle is rotated by means of the capper drive motor, and it is also used for guaranteeing an exact rotary positioning of the then passive upper part for another case of use.

Further more, it will be expedient when the upper part and a torque support, which is fixedly secured to the capper and which extends parallel thereto, have provided between them a selectively operable, preferably pneumatic clamping device, which is adapted to be displaced along the torque support in the released condition and which can be used for preferably fixing in position the upper part on a selected height level as well as for preferably rotationally fixing in position on the torque support a cover disk, which has attached thereto a capper guide path and which is to be non-rotatably supported when the capper is in operation. In view of the fact that the clamping device is movable along the torque support and supports the cover disk and the capper guide path in the course of this movement, the clamping device may, if appropriate, not be engaged during height adjustment, so that the upper part remains displaceable, without, however, rotating. When the capper is in operation (drive function activated), the clamping device may, however, be tightened, e.g. pneumatically, so as to maintain the adjusted height position of the upper part. This guided clamping device will also transmit the reaction force absorbed by the locking brake to the torque support, when the locking brake is arranged on the cover disk.

According to an expedient embodiment, the drive shaft extends through the capper drive motor. The operating shaft for the clutch system exits the free drive shaft end and is operatively connected to the pneumatic cylinder positioned there. The operating shaft can have arranged thereon a safety disk for height position sensing of the hollow spline shaft and of the gear coupling, respectively, and, consequently, indirectly of the upper part as well. This will provide information for automated height adjustment, said information being processed and stored by an adequately configured control unit. Samplers and/or sensors can additionally be positioned here and, if necessary, also in the interior of the clutch system.

According to another embodiment, a safety pin for the detent coupling as well as initiators (sensors, switches, switch keys and the like) used for monitoring the gear coupling and, if necessary, for height adjustment are positioned in an area between the free drive shaft end and the pneumatic cylinder, said area being preferably encapsulated and therefore easy to clean. It follows that this area of the capper can be utilized advantageously for executing e.g. automated height adjustments of the upper part and for obtaining, in so doing, precise information on the adjusted height position or the degree of height adjustment as well as the adequate functioning of the clutch system.

An expedient embodiment, in the case of which it is e.g. even possible to rotationally decouple the upper part from the capper drive motor by a very large vertical displacement, is so conceived that the upper part is rotationally connected at least to the outer shaft via a plurality of circumferentially distributed rotation-prevention pins which are displaceable parallel to the capper axis. This rotary connection is released by an excess vertical adjustment of the upper part until the upper part is rotationally decoupled from the capper drive motor, the rotation-prevention pins being withdrawn from their engaged position in the course of this process. A rotary bearing can preferably be provided between the hollow shaft and the upper part, and an anti-rotation device is provided, if necessary, between the hollow shaft and the outer shaft so as to guarantee that, in the rotationally decoupled condition of the upper part, the vertically adjustable hollow shaft can nevertheless rotate, whereas, when the upper part is vertically adjusted in the disengaged condition of the gear coupling and in a condition in which the upper part is locked against a rotary movement via the locking brake, the anti-rotation device between the outer shaft and the hollow shaft will prevent the hollow shaft from rotating together with the then driven threaded spindle.

According to an expedient embodiment of the capper, height adjustments of the upper part are executed in an automated mode via a control device, preferably with due regard to sort parameters of containers and/or caps and/or closing element types, said sort parameters being retrievably stored in the control device or inputted therein.

BRIEF DESCRIPTION OF THE DRAWINGS

Embodiments of the present disclosure are explained on the basis of the drawings, in which.

DETAILED DESCRIPTION OF THE PREFERRED EMBODIMENT

Figure 1:
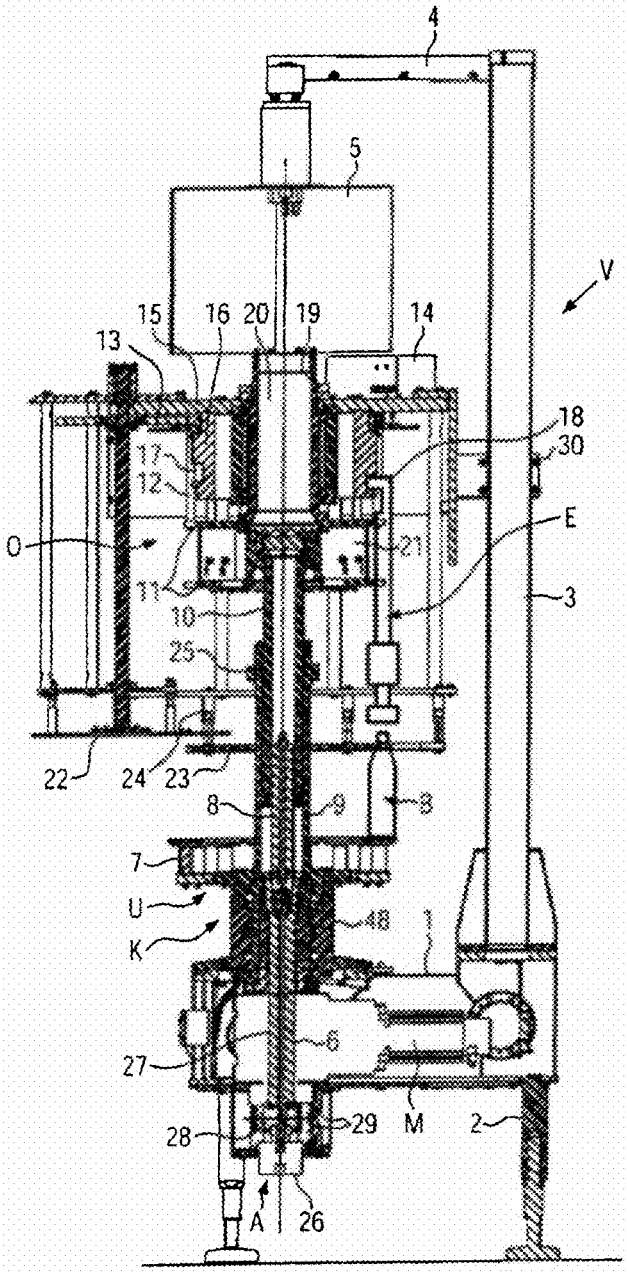
FIG. 1 shows a vertical section of a capper.

In a capper V, which is shown in FIG. 1 and which constitutes part of a container treatment machine that is not shown in detail, containers of any type consisting of any kind of material (glass, HDPE, PET, etc.) can be provided with various closures by means of closing elements E. The closing elements E can be screw cappers provided e.g. with a servo drive, crown cappers, natural corking machines, push-on cappers, roll-on cappers, sealing cappers and the like.

The capper V comprises e.g. a low-lying table 1 resting on the floor with support feet 2 and comprising a capper drive motor M, e.g. a servo-drive motor, which rotationally drives components in the capper V in asynchronous mode. A torque support 3 is arranged, preferably such that it extends parallel to the capper axis, and connected to the table 1, said torque support 3 extending in the vertical direction laterally adjacent the capper. The torque support 3 carries on the upper side thereof a cross piece 4, which is adapted to be used e.g. as channel for supplying media (pneumatic media, electric media) and which leads to an electronic tower 5, which is positioned on the axis of the capper and in which a control unit of the capper V can be accommodated in a shielded mode of arrangement.

The capper drive motor M is here provided with a hollow drive shaft 6 extending therethrough and driving, via a clutch system K switched to a switching position for a drive function, a container carrier 7 having arranged thereon containers B, e.g. bottles, which, if necessary, are positioned by manipulators that are not shown. The container carrier 7, which belongs to a lower part U supported on the table 1 in a main bearing 48, has connected thereto a hollow outer shaft 9 such that it is secured against rotation relative to said container carrier 7, said outer shaft 9 extending from the container carrier 7 upwards along the axis of the capper V in the direction of an upper part O. In the interior of said outer shaft 9, a hollow shaft 10, which is provided with a female thread at least in certain sections thereof, is guided in an at least vertically adjustable manner or is simply arranged therein, a threaded spindle 8, which is rotationally connected to the drive shaft 6, extending into said hollow shaft 10 from below in meshing engagement therewith. On the upper end of the hollow shaft 10 disk-shaped carriers 11 are arranged, which are configured as rotatable components of the upper part O and which are adapted to have mounted thereon circumferentially distributed closing elements E. Furthermore, a neck guide 23 is e.g. optionally connected to e.g. the upper part O such that it rotates together therewith, and a neck guide 23*a* is e.g. optionally provided such that is fixedly connected to the cover member 15 an as to assist in the container closing process. These neck guides can be used not only for supporting the containers B during the closing process, but, in a neck handling structural design, they can also be used directly as a container carrier and/or in combination with a container carrier 7. The carriers 11 have connected thereto a clamping disk 13 via pin-shaped entrainers 12, said clamping disk 13 being located directly below a non-rotatably supported cover member 15 and being intended for cooperation with an e.g. pneumatic locking brake 14 on the cover member 15, no as to rotatably lock the carriers 11 and possibly also the hollow shaft 10 when the upper part O is vertically adjusted relative to the lower part U. The lower surface of the cover member 15 has secured thereto an annular body 16 with a capper guide path 17, which is engaged by entrainers 18, e.g. with rollers, on the closing elements E. For this purpose, a respective necessary torque support (not shown) for guaranteeing a correct movement of the rollers is used. The carriers 11 are additionally rotatably supported in the cover member 15 via a sturdy hollow shaft section 19, the hollow shaft section 19 defining an interior channel 20 within which media conduits, which extend downwards from the electronic tower 5, can be conducted through openings up to and into areas 21 between the carriers 11 (not shown).

The cover member 15 has additionally mounted thereon a device 22, which is configured as a stationary pick and place station. The neck guide 23 encompassing the outer shaft 9 is, when the capper is in operation, rotationally driven or entrained by entrainers 24. The upper end of the outer shaft 9 has additionally provided thereon an entrainer collar 25 below a wiper ring, which is not shown in detail, said entrainer collar 25 being engaged (FIG. 5) by displaceable rotation-prevention pins 51 which extend parallel to the capper axis and are e.g. connected to the carriers 11, i.e. said rotation-prevention pins 51 will slide in the entrainer collar 25 (and there e.g. in sliding bushings) and thus transmit the rotary motion of the outer shaft 9 to the carriers 11 and the clamping disk 13, when the upper part O is vertically adjusted relative to the lower part U.

The cover member 15, with the capper guide path-including annular body 16 secured thereto on the lower surface thereof and the component 22, is, by a preferably pneumatic or spring-biased clamping device 30, prevented from rotating together with the upper part O and, if necessary, it is adapted to be clamped in position on the torque support 3 on the respective adjusted height level of the upper part O. In the released condition, the clamping device 30 can slide up and down on the torque support 3.

The hollow drive shaft 6 has arranged therein an operating shaft 27 for the clutch system K, said operating shaft 27 being functionally associated with an actuator A, e.g. a pneumatic cylinder 26. By means of the actuator A, the operating shaft 27 can be moved up and down at least in the axial direction (double arrow 31 in FIG. 2), so as to switch the clutch system K to a position corresponding to a drive function and to a position corresponding to a height adjustment function. When the clutch system K has been switched to the drive function, the drive shaft 6 will synchronously drive the container carrier 7, the outer shaft 9, the threaded spindle 8 and, via the outer shaft 9, at least also the carriers 11 in the upper part O. At least through the thread engagement between the threaded spindle 8 and the hollow shaft 10, also the hollow shaft 10 will rotate. When the clutch system K has been switched to the height adjustment function, the drive shaft 6 will, however, only drive the threaded spindle 8 so as to displace the hollow shaft 10 upwards or downwards and adjust the upper part O in its height position, whereas the container carrier 7 as well as the outer shaft 9 and, consequently, the carriers 11 in the upper part O will then be stationary. The hollow shaft 10, which may be connected to the carriers 11, is prevented from rotating together with the threaded spindle 8 through the actuated locking brake 14 and the clamping device 13, so that the rotary motion of the threaded spindle 8 generated by the capper drive motor M will cause a vertical adjustment of the hollow shaft 10 and, consequently, of the upper part O. If a rotary bearing 52 is, however, provided between the upper end of the hollow shaft 10 and the carriers 11 (cf. FIG. 5), it will be expedient to provide an anti-rotation device 53 (FIG. 5) between the outer shaft 9 and the hollow shaft 10, so that, during the vertical adjustment, the hollow shaft 10 will be axially guided and prevented from rotating in the outer shaft 9, whereas the threaded spindle 8 rotates.

Figure 5:
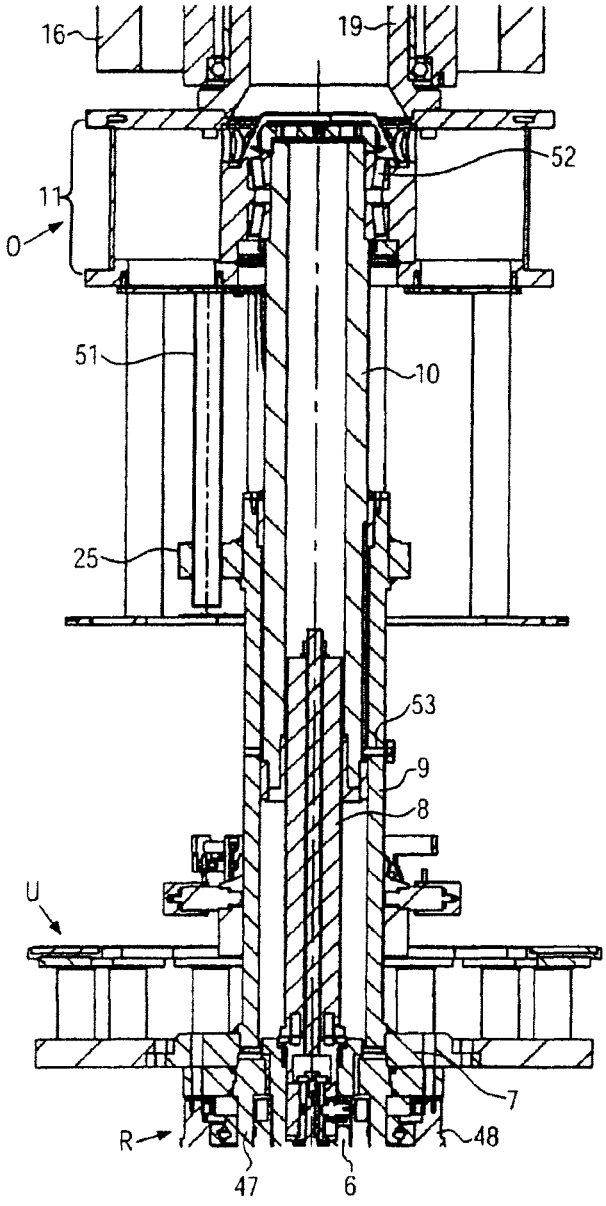
FIG. 5 shows a detailed axial section of a part of the capper.

The rotary bearing 52 shown in FIG. 5 between the carriers 11 and the upper end of the hollow shaft 10 will (in combination with the anti-rotation device 53) especially be expedient in cases where the height adjustment of the upper part O by means of the capper drive motor M is also used for the purpose of fully decoupling rotatable components of the upper part O from the drive shaft 6 and for isolating the upper part upper part O from the lower part U. This may be of advantage in an operating phase of the capper V in which the latter, as a component of a group of machines, only executes a transport function by means of the container carrier 7, whereas the upper part O remains passive and no application of caps takes place.

As can be seen from FIG. 5 in connection with FIG. 1, this rotational decoupling between the upper part O and the lower part U and the capper drive motor M, respectively, is carried out in that the rotation-prevention pins 51 are removed from the entrainer collar 25 of the outer shaft 9 by an excess vertical adjustment of the upper part O in the upward direction. In so doing, it will be expedient to engage the locking brake 14 and to keep it engaged so that the rotary position of the upper part O will be maintained until, for a future operating phase in which the upper part O is active once more, the rotation-prevention pins 51 will be reintroduced in the entrainer collar 25.

In FIG. 5 it is also indicated how the media conduits can be introduced in the intervals between the carriers 11 through the hollow shaft section 19 and openings above the rotary bearing 52.

In the following, the clutch system K, which is only schematically indicated in FIG. 1, will explained in more detail.

Figure 2:
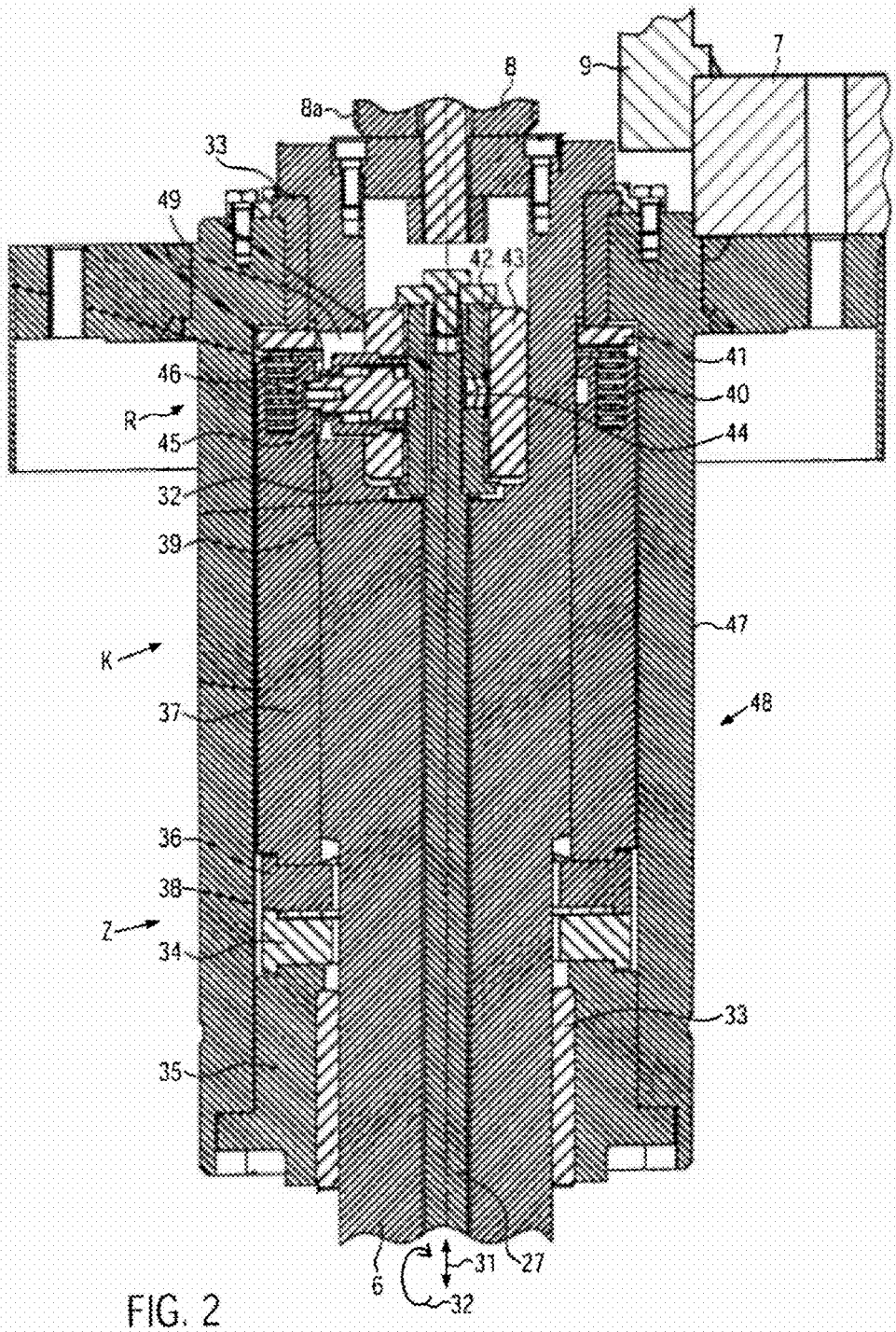
FIG. 2 shows an enlarged detail of FIG. 1 for illustrating a clutch system.

FIG. 2 shows the head portion of the drive shaft 6, which contains the operating shaft 27 in its central internal bore. The operating shaft 27 is adjusted by the actuator A of FIG. 1, e.g. in the direction of the double arrow 31, between two different height positions so as to switch the clutch system K between the position corresponding to the drive function (shown in FIG. 2) and the upper-part height adjustment function (not shown).

In the embodiment shown, the clutch system K comprises a gear coupling Z as well as a detent coupling R. The drive shaft 6 is rotatably supported in rotary bearings 33 (plain bearings) in an outer tube 47, which, on the upper end thereof, supports the container carrier 7 such that it is secured against rotation relative thereto; preferably, the upwardly projecting outer shaft 9 is non-rotatably connected to (e.g. welded to) the container carrier 7 or to the outer tube 47. At the upper end, the drive shaft 6 is screw-fastened to the lower end of the threaded spindle 8 (male thread 8*a*) in the area of the rotary bearing 33.

Figure 4:
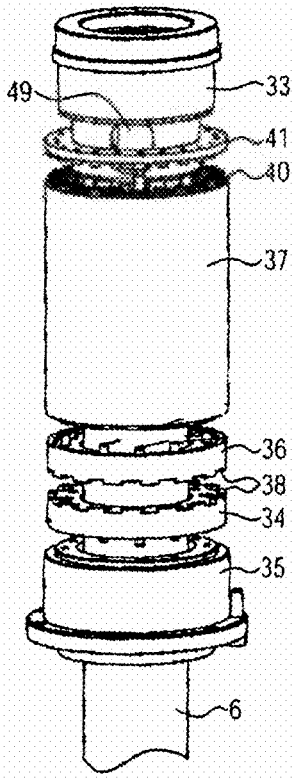
FIG. 4 shows a perspective view of a part of the drive shaft with components of the clutch system.

The gear coupling Z consists of a circular ring disk 34 on an insert 35 in the outer tube 47 and a circular ring disk 36 on the lower end of a hollow spline shaft 37, said circular ring disks 36, 34 having provided between them meshing teeth 38, as can be seen in detail e.g. from FIG. 4. These teeth are spur gear teeth which are adapted to one another and provided on the circular ring disks 34, 36. The number of tooth engagement possibilities correlates directly with the number of parts, i.e. with the number of closing elements E incorporated in the capper. Alternatively, the coupling may also be configured such that it does not comprise gear teeth correlating with the number of parts, e.g. when the capper drive motor M—implemented as a servo drive motor—is adequately programmed.

The drive shaft 6 is provided with a taper key structure 32 in an upper outer peripheral area thereof, said taper key structure 32 being engaged by a complementary taper key structure 39 of the hollow spline shaft 37 which is axially displaceable on the drive shaft 6 so that the hollow spline shaft 37 and the drive shaft 6 will rotate synchronously. The outer tube 47 is, by the way, rotatably supported through rotary bearings, which are not show, in the main bearing 48 on the table 1.

The gear coupling Z is spring biased into the position of engagement, e.g. by means of springs 40 positioned in suitable, circumferentially distributed blind holes in the upper end face of the hollow spline shaft 37 and resting on a circular ring disk 41 which abuts on the rotary bearing 33. In the switching position shown (drive function), the gear coupling Z is engaged. The upper end face of the hollow spline shaft 37 extends at an axial distance of e.g. 4 mm from the circular ring disk 41. As has already been mentioned, the drive shaft 6 drives, via the detent coupling R, the hollow spline shaft 37, which drives the outer tube 47 via the gear coupling Z, whereas the upper end of the drive shaft 6 drives simultaneously the threaded spindle 8.

The detent coupling R has a double function. On the one hand, it connects the drive shaft 6 and the hollow spline shaft 37 in the position of engagement shown, and, on the other hand, it serves to move the hollow spline shaft 37 upwards from the position shown in FIG. 2, possibly until it comes into contact with the circular ring disk 41, so as to disengage the gear coupling Z.

The detent coupling R comprises an internal bushing 42, which is rotationally coupled to the operating shaft 27, and an external bushing 43, which is press-fitted into an inner chamber of the drive shaft 6 (or rotationally coupled thereto). The internal bushing 42 is provided with engagement recesses 44 for the inner ends of e.g. three locking entrainers 45, which are arranged in a star-shaped mode and which are radially displaceable, e.g. under spring force, in the external bushing 43, the outer ends of said locking entrainers 45 engaging engagement recesses 46 provided in the inner wall of the hollow spline shaft 37. The locking entrainers 45 are acted upon, e.g. by the force of a spring, in the direction of the internal bushing 42. The engagement recesses 44 of the internal bushing, which is rotatable relative to the external bushing 43, have an engagement depth varying in the circumferential direction e.g. with a three-sectional division so that through a six-sectional partial rotation of the operating shaft 27 (double arrow 31' in FIG. 2) with the internal bushing 42 relative to the drive shaft 6 the locking entrainers 45, which project outwards through windows 49 of the drive shaft 6, can be drawn back into said windows 49 and released from engagement with the engagement recesses 46, so as to separate the drive shaft 6 from the hollow spline shaft 37. This function of the detent coupling R will be expedient in particular when the clutch system K is mounted or demounted.

For switching the clutch system K to the position corresponding to the height adjustment function, the operating shaft 27 is only moved linearly up and down, as has already been mentioned. The gear coupling Z and the detent coupling R are, of course, only operated when the capper drive motor M stands still.

Figure 3:
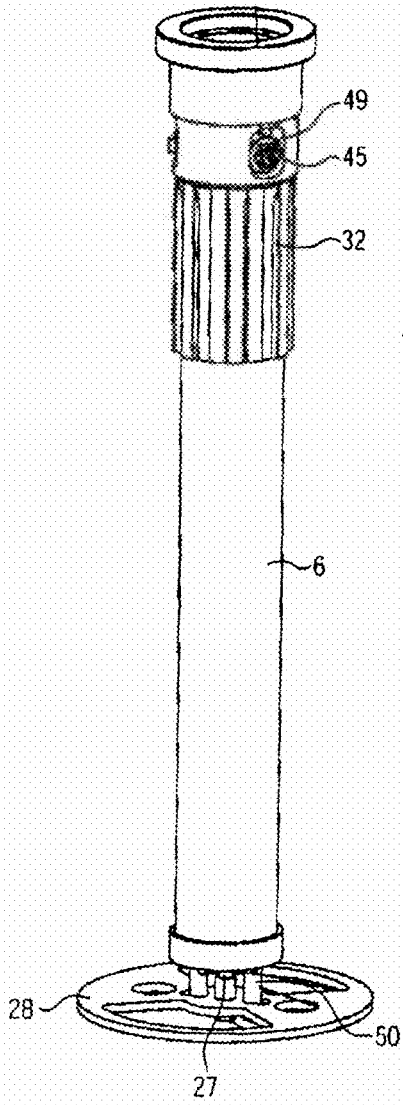
FIG. 3 shows a perspective view of a drive shaft and of the components associated therewith.

The view of the drive shaft 6 in FIG. 3 shows clearly how the locking entrainers 45 project outwards through the windows 49 above the taper key structure 32 (corresponding to the position shown in FIG. 2) and how the operating shaft 27 exits the drive shaft at the free lower end thereof and carries there e.g. the safety disk 28 for height sensing, e.g. by the initiators 29 schematically outlined in FIG. 1. A great variety of sensor systems can be used as initiators 29, such as proximity switches, key switches, etc. Depending on the respective mounting position and structural design, it may also be possible to use only a single sensor of this type. Furthermore, two safety pins 50 for the detent coupling R are outlined in FIG. 3, which, if necessary, may be adjusted or removed by an actuator (not shown) or the like so as to e.g. disengage the detent coupling R.

In FIG. 4 a plurality of components of the clutch system K are threaded onto the drive shaft 6 e.g. from below, viz., starting from below, the insert 35, the circular ring disks 34, 36 with the spur gear teeth 38, the hollow spline shaft 37 with springs 40 that can be seen on the upper end face thereof, the circular ring disk 41 and, finally, the rotary bearing 33 (plain bearing).

The gear coupling Z is disengaged pneumatically, in this case indirectly via the operating shaft 27, against a biasing force applied by the springs 40. The correct disengagement of the gear coupling Z is confirmed, e.g. pneumatically, via a special key switch (not shown). It follows that the disengagement of the gear coupling and the confirmation of the execution of the disengagement operation take place fully pneumatically within the capper V. When the gear coupling Z has been disengaged, the capper drive motor M can be restarted for the purpose of height adjustment so as to adjust the desired height of the upper part O or so as to even fully isolate said upper part O. A comparatively large height adjustment range can be utilized, without the necessity of using any additional drive motor for the purpose of height adjustment. The whole drive system and the internal components are shielded against cleaning media and other external influences, which means that the capper V can be thoroughly cleaned also at locations where such cleaning has hitherto not been admissible. The height adjustment is preferably fully automated and can be executed e.g. with due regard to the sort parameters; this can be accomplished via a control unit of the capper V which is not shown. For example, a height adjustment range of 250 mm can be achieved, the adjustment accuracy being, thanks to the precision of the servo-drive motor, approx. ±0.2 mm, depending on the respective structural design. In this respect, also the spindle pitch is of influence. An additional advantage is to be seen in that the upper part O can be fully rotationally decoupled from the capper drive motor M so that the conveying function of the container carrier 7 can be utilized as an isolated function.

A height adjustment of the upper part is executed e.g. as described herein below, starting from a production state:

1. The capper V is stopped either at an arbitrary stop point or at a fixed rotary angle for height adjustment.

2. The upper part O is locked in position in the direction of rotation by means of the locking brake 14, 13.

3. The gear coupling Z is disengaged so as to interrupt the rotary connection between the hollow spline shaft 37 and the outer tube 47.

4. The clamping device 30 on the torque support 3 is released and the upper part is thus rendered vertically movable.

5. A special sensor or the initiators 29 confirm that the gear coupling Z has been disengaged correctly and transmit so to speak the permission to execute the height adjustment to the control unit.

6. The capper drive motor M is actuated by the control unit and rotates the threaded spindle 8, depending on the transmission ratio and the thread pitch of the threaded spindle 8, until the hollow shaft 10 has arrived on the desired height level, which is either programmed or determined by sensors that are not shown. The capper drive motor M is stopped.

7. The pneumatic cylinder 26 relieves the operating shaft 27 so that the springs 40 will push the hollow spline shaft 37 downwards and engage the gear coupling Z. The drive shaft 6 can be rotated slowly (creep speed) via the capper drive motor for the purpose of finding the engagement position of the spur gear teeth 38 on the circular ring disks 34, 36. The correct engagement of the gear coupling Z is registered and reported to the control unit. This has the effect that an enable instruction is outputted, which confirms that switching to the drive function is allowed.

8. The clamping device 30 on the torque support 3 is fixed, and the upper part is thus locked at the respective height position.

9. The locking brake 14 is released. The release position of the locking brake 14 is reported to the control unit.

10. The production operation of the capper is started again.

An automated height adjustment is here carried out in a particularly advantageous manner. This will also be expedient in cases where the capper works in a clean room environment, since it will then not be necessary that operating personnel enters the clean room in order to carry out a height adjustment. Thanks to the large height adjustment range all known container sizes can be dealt with. Furthermore, it is possible to equip a great variety of capper types (ALU, SV, KK, NK, ASK, etc.) and all capper sizes (TK) with this height adjustment means.

The invention claimed is:

1. A capper for containers, comprising a container carrier, which is adapted to be driven by a capper drive motor for transporting the containers on a lower part of the capper, and an upper part of the capper, which upper part carries at least one closing element and which is also adapted to be driven by the capper drive motor, the upper part being adjustable in height relative to the lower part at least for adaptation to different container heights, wherein the upper part of the capper is adjustable in height by means of the capper drive motor via a clutch system which is adapted to be selectively switched between a lower part and an upper part drive function and an upper-part height adjustment function.

2. A capper according to claim 1, wherein the capper drive motor is a servo-drive motor arranged in a table carrying the lower part.

3. A capper according to claim 1, wherein with the clutch system selectively switched to the upper-part height adjustment function, the upper part is vertically adjustable relative to the lower part until it is rotationally decoupled from the capper drive motor.

4. A capper according to claim 1, wherein the upper part and the lower part have provided between them a hollow shaft, which is provided with a female thread and which is vertically adjustable relative to the lower part in an outer shaft connected to the container carrier, and a threaded spindle, which is disposed in the interior of the hollow shaft and rotationally connected to the capper drive motor and which is provided with a male thread that is in mesh with the female thread, and that, when the upper-part height adjustment function is activated, the threaded spindle is adapted to be rotated relative to the hollow shaft by means of the capper drive motor and vertically adjusts the hollow shaft with the upper part relative to the outer shaft.

5. A capper according to claim 4, wherein the clutch system comprises a hollow spline shaft, which is provided on a drive shaft with a taper key structure connected to the capper drive motor and the threaded spindle and which is adapted to be linearly adjusted in the interior of an outer tube, which is connected to the container carrier, on the drive shaft between positions corresponding to the drive function and the upper-part height adjustment function, and a gear coupling provided between the hollow spline shaft and the outer tube, the gear coupling being adapted to be engaged and disengaged through the linear displacement of the hollow spline shaft and being adapted to be used for selectively establishing a rotary connection between the hollow spline shaft and the outer tube.

6. A capper according to claim 5, wherein the gear coupling is spring-biased into the position of engagement.

7. A capper according to claim 6, wherein the spring-bias is caused by springs provided between the hollow spline shaft and a rotary bearing of the drive shaft in the outer tube.

8. A capper according to claim 5, wherein the gear coupling is adapted to be disengaged directly or indirectly by a remotely controllable actuator.

9. A capper according to claim 8, the drive shaft extends down-wards through the capper drive motor, that the operating shaft exits the free drive shaft end and is operatively connected to the pneumatic cylinder, and that the operating shaft has arranged thereon a safety disk for height position sensing of the hollow spline shaft and of the gear coupling and of the upper part, respectively.

10. A capper according to claim 9, wherein, in an area between the free drive shaft end and the pneumatic cylinder, a safety pin for the detent coupling as well as initiators used for gear-coupling and/or height-adjustment monitoring are positioned.

11. A capper according to claim 10, wherein the area is encapsulated.

12. A capper according to claim 8, wherein the remotely controllable actuator is a pneumatic cylinder.

13. A capper according to claim 12, wherein the gear coupling is disengageable indirectly by means of an operating shaft, which is linearly displaceable by the pneumatic cylinder and which is displaceably arranged in the drive shaft and coupled to the hollow spline shaft.

14. A capper according to claim 13, wherein the operating shaft and the hollow spline shaft have provided between them a selectively releasable detent coupling.

15. A capper according to claim 14, wherein the detent coupling is provided with locking entrainers which are arranged on the operating shaft and which are adapted to be inserted in a star-shaped mode into engagement recesses of the hollow spline shaft through windows of the drive shaft, the locking entrainers being retractable into the windows by means of a partial rotational movement of the operating shaft relative to the drive shaft.

16. A capper according to claim 15, wherein the locking entrainers are retractable under spring force.

17. A capper according to claim 4, wherein the upper part is rotationally connected at least to the outer shaft via a plurality of circumferentially distributed rotation-prevention pins which are displaceable parallel to the capper axis, and that the rotary connection can be released by an excess vertical adjustment of the upper part until the upper part is rotationally decoupled from the capper drive motor.

18. A capper according to claim 17, and wherein a rotary bearing is provided between the hollow shaft and the upper part.

19. A capper according to claim 17, and wherein an anti-rotation device is provided between the hollow shaft and the outer shaft.

20. A capper according to claim 1, and a selectively operable locking brake is provided for the rotationally driveable upper part.

21. A capper according to claim 20, wherein the locking brake is one of mechanically, pneumatically or magnetically operated.

22. A capper according to claim 20, and wherein the locking brake is provided between a clamping disk of the upper part (O) and a non-rotatably supported cover disk.

23. A capper according to claim 1, wherein the upper part and a torque support, which is fixedly secured to the capper and which extends parallel thereto, have provided between them a selectively operable clamping device, which is adapted to be displaced along the torque support and which can be used for fixing in position the upper part on a selected height level as well as for fixing in position on the torque support a cover disk, which has attached thereto a capper guide path and which is to be non-rotatably supported when the capper is in operation.

24. A capper according to claim 23, wherein the clamping device is pneumatically operated.

25. A capper according to claim 1, wherein height adjustments of the upper part can be executed in an automated mode via a control device.

26. A capper according to claim 25, and wherein the execution in an automated mode is with due regard to sort parameters of one of containers, caps, closing element types, or a combination thereof, and the sort parameters are retrievably stored in the control device or inputted therein.

* * * * *